US007113137B2

(12) United States Patent
Bisig

(10) Patent No.: US 7,113,137 B2
(45) Date of Patent: Sep. 26, 2006

(54) VHF WAVE RECEIVER ANTENNA HOUSED IN A WRISTBAND OF A PORTABLE ELECTRONIC DEVICE

(75) Inventor: Martin Bisig, Zuchwil (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 84 days.

(21) Appl. No.: 10/496,648

(22) PCT Filed: Oct. 31, 2002

(86) PCT No.: PCT/EP02/12177

§ 371 (c)(1),
(2), (4) Date: May 25, 2004

(87) PCT Pub. No.: WO03/061066

PCT Pub. Date: Jul. 24, 2003

(65) Prior Publication Data

US 2005/0012671 A1 Jan. 20, 2005

(30) Foreign Application Priority Data

Nov. 26, 2001 (EP) ..... 01204565

(51) Int. Cl.
*H01Q 1/12* (2006.01)
*G04B 47/00* (2006.01)

(52) U.S. Cl. ..... 343/718; 368/10

(58) Field of Classification Search ..... 343/895, 343/702, 700 MS, 872, 716, 904, 718; 368/10, 368/278

See application file for complete search history.

(56) References Cited

U.S. PATENT DOCUMENTS

| | | | | |
|---|---|---|---|---|
| 4,754,285 | A | 6/1988 | Robitaille | |
| 5,083,134 | A * | 1/1992 | Saitou et al. | 343/713 |
| 5,541,399 | A * | 7/1996 | de Vall | 235/491 |
| 6,378,774 | B1 * | 4/2002 | Emori et al. | 235/492 |
| 6,665,931 | B1 * | 12/2003 | Yamaguchi et al. | 29/850 |

FOREIGN PATENT DOCUMENTS

| | | |
|---|---|---|
| EP | 631 341 A1 | 12/1994 |
| EP | 1 033 636 A1 | 3/1999 |
| EP | 1 014 231 A1 | 6/2000 |
| GB | 94 02 573.8 U1 | 7/1995 |
| WO | WO 01/059717 A1 | 9/2001 |

* cited by examiner

*Primary Examiner*—Shih-Chao Chen
*Assistant Examiner*—Minh Dieu A
(74) *Attorney, Agent, or Firm*—Sughrue Mion, PLLC

(57) ABSTRACT

There is disclosed a portable electronic device (15) including an electronic circuit for receiving radiobroadcast signals whose frequency belongs to the very high frequency range (VHF). Said receiving circuit includes, in particular, an antenna (1) including one or more coils (2, 27) each having a generally flat spiral-shaped winding housed in the wristband of the portable device (15). One thus obtains a very high quality and compact radiobroadcast signal receiving circuit.

17 Claims, 3 Drawing Sheets

VHF WAVE RECEIVER ANTENNA HOUSED IN A WRISTBAND OF A PORTABLE ELECTRONIC DEVICE

This application is a 371 of PCT/EP02/12177 Oct. 31, 2002.

BACKGROUND OF THE INVENTION

The present invention concerns a portable electronic device including a wristband, a case and an electronic circuit for receiving radiobroadcast signals comprising an antenna disposed in said wristband.

More precisely, the present invention concerns a particular antenna structure that allows the portable device to receive signals whose frequency is located in the very high frequency range, i.e. VHF waves, with a high level of sensitivity. Preferably, said antenna is capable of receiving signals belonging to the FM ("frequency modulation") band frequency range, in other words whose frequency is substantially comprised between 87 and 110 MHz.

Such devices have already been disclosed in the prior art and in particular, very varied antenna structures have been proposed.

One may, for example, refer to U.S. Pat. No. 4,754,285, granted 28 Jun. 1988, which discloses a wristwatch incorporating in particular a circuit for receiving radiobroadcast signals requiring the use of an antenna. The solution disclosed consists in arranging a metal wire in an extensible wristband across its entire length and such that said wire goes successively around in the direction of the width of said wristband. Thus, the length of the wire is greater than the length of said wristband in the rest position, which then allows the wristband to be extended.

However, this solution, in addition to taking up a significant amount of space in the wristband, is not suitable for watches whose wristband comprises two strands closing over each other via a fastening device.

Other solutions have been presented to respond to this particular case, such as a simple metal wire loop passing through each of the two strands of the wristband from the end connected to the watchcase to the end carrying the means for fastening it to the other strand. Means are also provided for establishing an electric connection between the two parts of the loop at the location of the fastening means.

However, these connection means complicate the construction of the wristband, all the more so since they are preferably protected from the external environment, in particular from the perspiration of the person wearing the watch, which means significant protective measures have to be taken.

SUMMARY OF THE INVENTION

The Applicant has demonstrated, during his research, that it is possible, owing to the present invention, to improve the aforementioned portable electronic devices, particularly owing to a simple antenna structure, which, despite its simplicity, provides good VHF radiobroadcast signal reception sensitivity. The solution according to the present invention allows the use of this type of antenna without requiring profound modifications to the constructions of the prior art to be integrated therein.

The invention thus concerns a portable electronic device of the type indicated hereinbefore, characterised in that said antenna includes at least one flat coil made in the form of a spiral winding.

Thus, the space requirement of the antenna in the wristband is greatly limited while ensuring that the electronic device according to the present invention has optimal reception quality.

In a second embodiment, said antenna may include a second flat coil made in the form of a spiral winding. This allows the sensitivity of the device according to the present invention to be further improved, insofar as the two coils are series connected, involving only a very slight increase in the space requirement of the antenna in the wristband. One may imagine, to implement the present embodiment in a device comprising a wristband made in two independent parts, disposing a first of said two coils in a first strand, whereas the second coil is disposed in the second wristband strand.

One may also imagine that each coil is made by depositing a copper path, for example, on a substrate and that, in this case, a first coil is arranged on a first face of said substrate whereas the second coil is arranged on the second face of the substrate. This variant facilitates the connection means with the integrated circuit of the radiobroadcast signal reception circuit, in particular when the latter is housed in the case of the electronic device.

It is, of course, preferable for the substrate used to support the antenna according to the present invention to be made of a flexible material, so as to allow the wristband to be deformed.

Generally, since the integrated circuit of the reception circuit is disposed in the case of the electronic device metal paths are used to connect it to the ends of the coil or coils. These metal paths are preferably supported by an extension of the substrate which is extended into the interior of said case.

Further, because of the specific spiral shape of the coil, an opening is arranged in the substrate to allow the inner end of said coil to be connected to said corresponding metal path.

In a preferred embodiment, the solution described hereinbefore is implemented in a timepiece, the case comprising, in this case, a timepiece movement coupled to time display means.

BRIEF DESCRIPTION OF THE DRAWINGS

Other features and advantages of the present invention will appear upon reading the following detailed description, made with reference to the annexed drawings, given by way of example and in which.

DETAILED DESCRIPTION OF THE INVENTION

Figure 1:
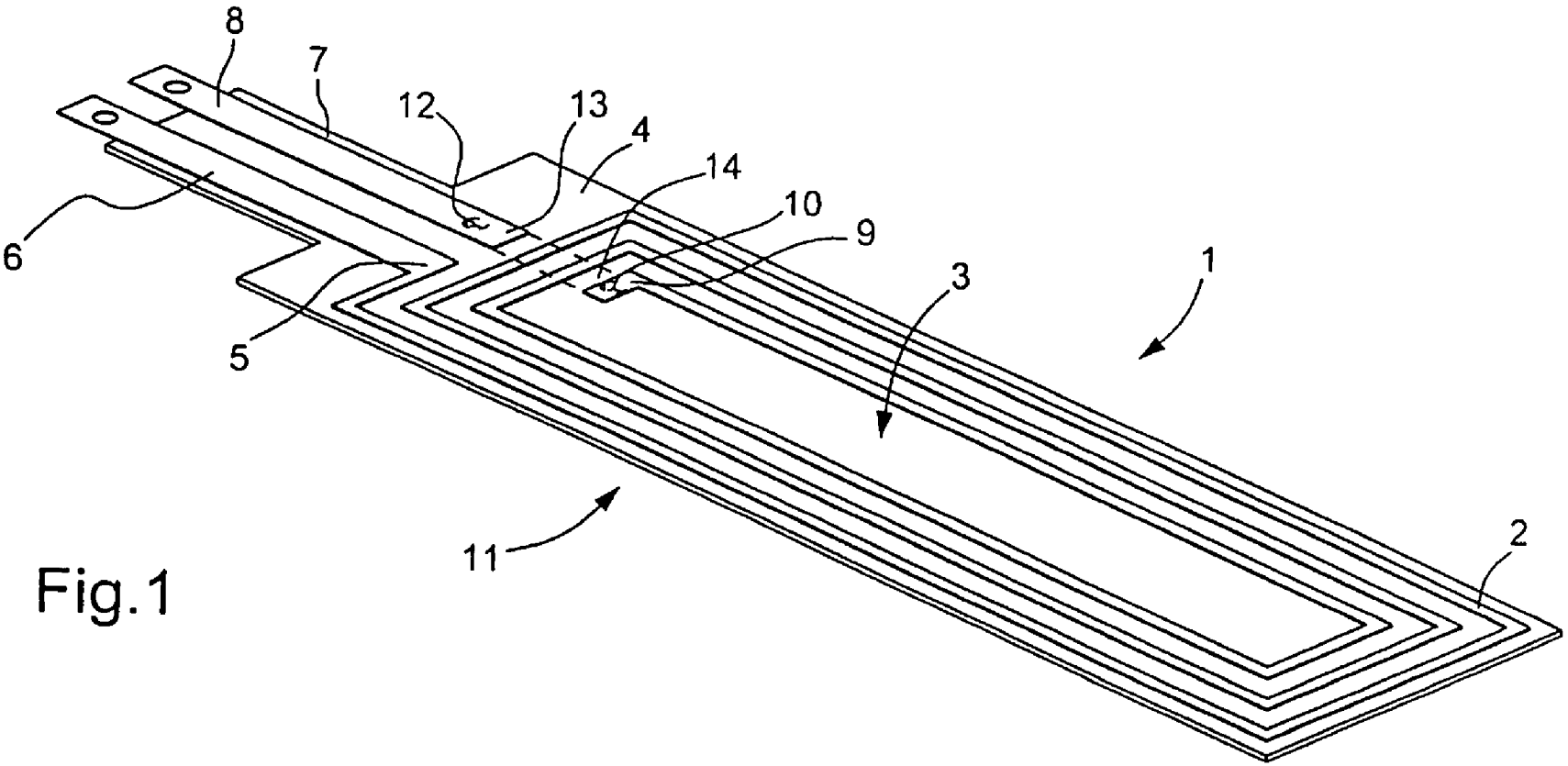
FIG. 1 is a top view of an embodiment of the antenna according to the present invention.

FIG. 1 is a general elevation view of an antenna 1 comprising a single coil 2, according to a main embodiment of the present invention, showing the specific shape of said spiral wound coil. It will also be noted that coil 2, preferably made of copper and having a low thickness of the order of several micrometers, is arranged on the front face 3 of a substrate 4.

With the object of optimising the available surface in a wristband, substrate 4 has a substantially rectangular shape.

Likewise, the spiral winding of coil 2 has a generally substantially rectangular shape, so as to optimise the available substrate surface.

A particularly advantageous system is thus obtained in that the surface of coil 2 can be much greater than if it were housed in the case of the portable device.

Figure 2:
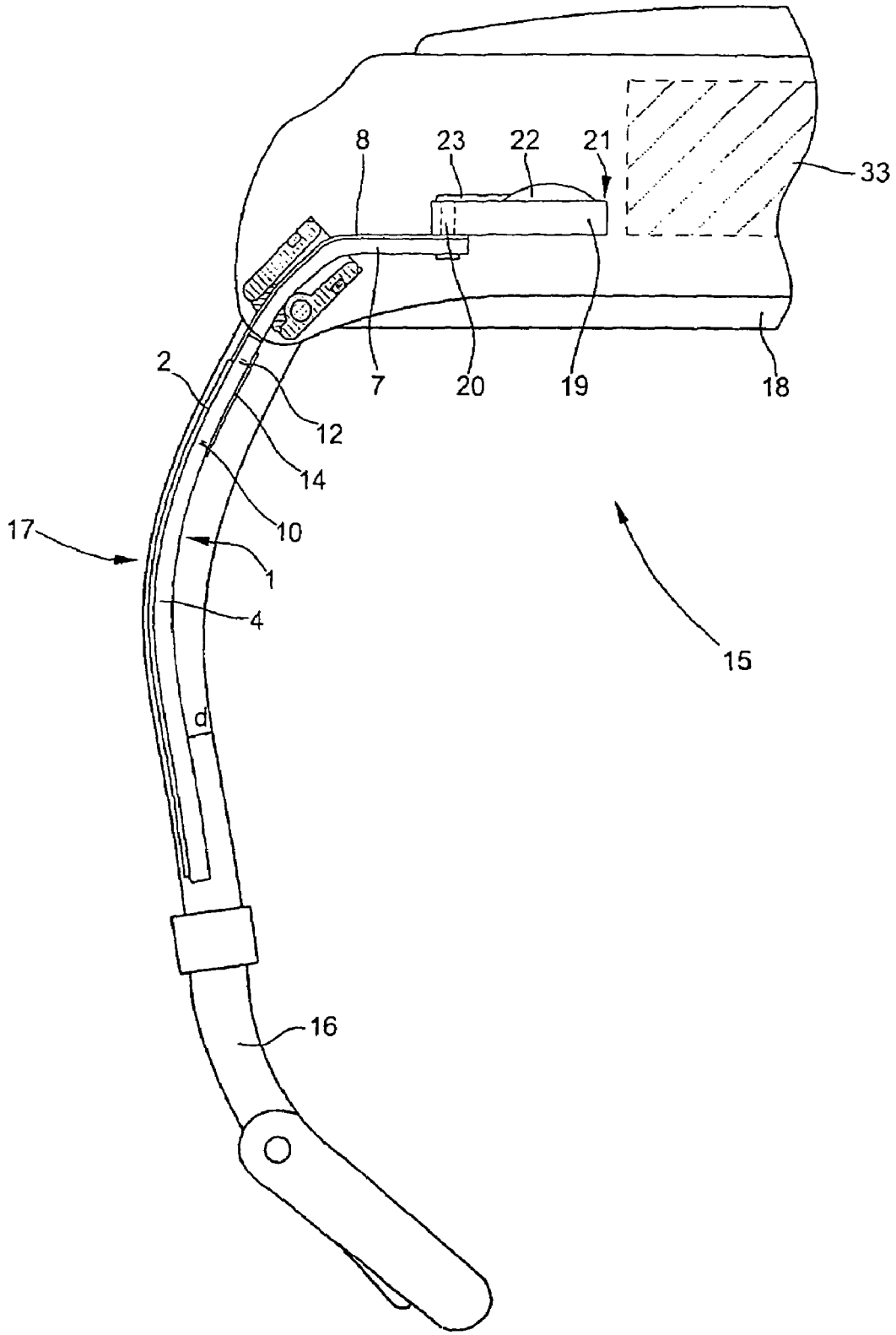
FIG. 2 is a simplified see through view of the electronic device incorporating the antenna shown in FIG. 1, according to a preferred embodiment of the invention.

A first end 5 of coil 2 is located outside the spiral and is extended by an elongated rectangular connector 6, arranged on an extension 7 of substrate 4 and intended to connect said first end 5 of coil 2 to an integrated circuit (visible in FIG. 2).

A second elongated rectangular connector 8 is arranged on said extension 7 of the substrate, parallel to first connector 6, and is intended to connect second end 9 of coil 2 to said integrated circuit. Since said second end 9 is located inside the spiral, an opening 10 is arranged through substrate 4 and filled with a material having a high electric conduction level. Thus, an electric contact with second end 9 of coil 2 is made available on back face 11 of substrate 4. Likewise, an opening 12 is arranged through substrate 4 and filled with an electrically conductive material, underneath end 13 of second connector 8 located on the side of coil 2, so as to form an electric contact with said second connector 8 on back face 11 of the substrate. A metallisation path 14 is further provided to finalise the electric connection between second end 9 of coil 2 and second rectangular connector 8. This structure has been described by way of non-limiting example and those skilled in the art will be able to use any other equivalent structure ensuring the electric connection function.

Since antenna 1 shown in FIG. 1 is intended to be housed in the wristband of a portable device, said substrate 4 is advantageously made of a flexible material, in particular when a deformable wristband is provided for carrying the electronic device according to the invention. In this case, materials such as Kapton (registered trademark) can be used or any other material having equivalent properties of adhesion to copper and flexibility. Moreover, said substrate 4 has a thickness of the order of several tens of micrometers.

The manufacture of said antenna 1 relies on techniques known in the prior art, particularly in the field of printed circuit manufacture. Indeed, those skilled in the art will be able to adapt one of the conventional methods in said field without any particular difficulty.

By way of example, one can start with a film of Kapton, cut to the appropriate dimensions and including the two apertures 10 and 12 described hereinbefore, that have been filled with an electrically conductive material. This film, thus prepared defines substrate 4 of antenna 1. A film of copper is then bonded onto each of faces 3, 11 of said substrate. The two copper films are partially protected so as to leave free the portions that do not correspond to the pattern of coil 2, nor to that of connectors 6 and 8, nor to that of metallisation path 14 located on back face 11 of the substrate. Said free portions are then etched so as to obtain a coil 2 and connectors 6, 8 as shown in FIG. 1, for example.

It may be noted that depending on the frequency at which antenna 1 shown in FIG. 1 has to operate, those skilled in the art have to pay particular attention to adapting the dimensions of the spiral. Indeed, a well known phenomenon in the field of antennae comprising coils is the risk of capacitive coupling being able to appear between neighbouring turns. Those skilled in the art will thus have to take care to properly define the distances existing between two consecutive turns of the spiral, particularly as a function of the thickness of copper used to make the coil and the operating frequency, the capacitive coupling increasing with said frequency.

FIG. 2 shows a see through view of portable electronic device 15 according to the invention, incorporating antenna 1 which has just been described in a strand 16 of the wristband. It will be noted in this Figure that the dimensions of antenna 1 according to the invention advantageously allow portable device 15 to be fitted with a wristband having the usual dimensions.

Antenna 1 is shown here in a bent configuration, illustrating the properties of flexibility of substrate 4. The great importance of the choice made to arrange antenna 1 in proximity to top surface 17. i.e. external surface, of strand 16 should be noted here. Indeed, the human body is usually responsible for a decrease in the sensitivity of an antenna which is arranged in proximity to it, by a shielding effect, which is why the distance d has to have the highest possible value. Thus, the antenna of the electronic device according to the invention has high radiobroadcast signal reception sensitivity.

From the practical point of view, the integration of antenna 1 in the wristband of electronic device 15 can be achieved in various ways. One can, for example, overmould antenna 1 directly in a wristband strand 16 when the latter is made of plastic material, leaving extension 7 of substrate 4 free. One can also use a wristband strand 16 having a recess in the material forming the strand, of substantially greater dimensions than the dimensions of antenna 1, such that the latter can be slipped into it. One can also simply use a wristband strand 16 in two layers, the two layers being for example sewn onto each other while antenna 1 is disposed between them.

Of course, it is clear that the portable electronic device is not limited by the wristband structure, which may include one or two strands and which may or may not be extending.

It is also apparent from this Figure that extension 7 of substrate 4 carrying rectangular connectors 6 and 8 extends inside case 18 of portable electronic device 15, to the contact of a printed circuit board 19. The latter includes two apertures 20 (only one of which is visible in FIG. 2) passing through it entirely and filled with an electrically conductive material. Rectangular connectors 6 and 8 are respectively connected to said printed circuit board 19, respectively at each of said apertures 20 so as to define an electric contact with each of ends 5 and 9 of coil 2 on top face 21 of printed circuit board 19. The connection between connectors 6 and 8 and printed circuit board 19 is achieved in a conventional manner, i.e. by soldering, screws, bonding using an electrically conductive adhesive, or by any other equivalent means.

An integrated circuit 22 is also carried by printed circuit board 19 and is connected to said electric contacts 20 by metallisation paths 23 (only one of which is visible in FIG. 2). This integrated circuit 22 processes the radiobroadcast signals received by antenna 1 to then be able to make them accessible, to a user of portable electronic device 15 according to the invention, in a directly exploitable form. This aspect of the operation of portable electronic device 15 will not be addressed here in detail insofar as it is only of a secondary nature in the present invention.

The construction details concerning the passage of extension 7 of substrate 4 carrying the two rectangular connectors 6 and 8 will not be developed further either since numerous solutions have already been presented in documents of the prior art. The interested reader will, for example, be able to consult European Patent Application No. 1 033 636, published $6^{th}$ Sep. 2000, the content of which is incorporated by reference in the present Application.

Indeed, the description of this Patent Application shows several embodiments of the passage of electric connectors through a watchcase in a watertight manner. Overall, the solution disclosed in this Patent Application consists in arranging an aperture on the side of the watchcase, in which a passage 24, of substantially tubular shape, is arranged. Sealing means 25 are provided between watchcase 18 and the exterior of tubular passage 24. The electric connectors are guided inside the watchcase by the passage and means are also provided to ensure sealing of the interior of passage 24 with respect to the exterior of the watchcase. These sealing means are for example made in the form of a joint 26 overmoulded around the electric connectors and having the same shape as the interior of the passage, thus ensuring the function of a plug.

Means such as electric connectors that do not themselves penetrate the interior of the case of the electronic device may be provided. One may for example use a set of combined contacts as described in European Patent Application No 0 186 804 or even a capacitive coupling achieved through the case of the device as described in European Patent Application No. 1 014 231. This latter embodiment advantageously facilitates the construction of case 18 of the device from the point of view of sealing, insofar as it is not necessary for apertures to be made in said case.

Figure 3:
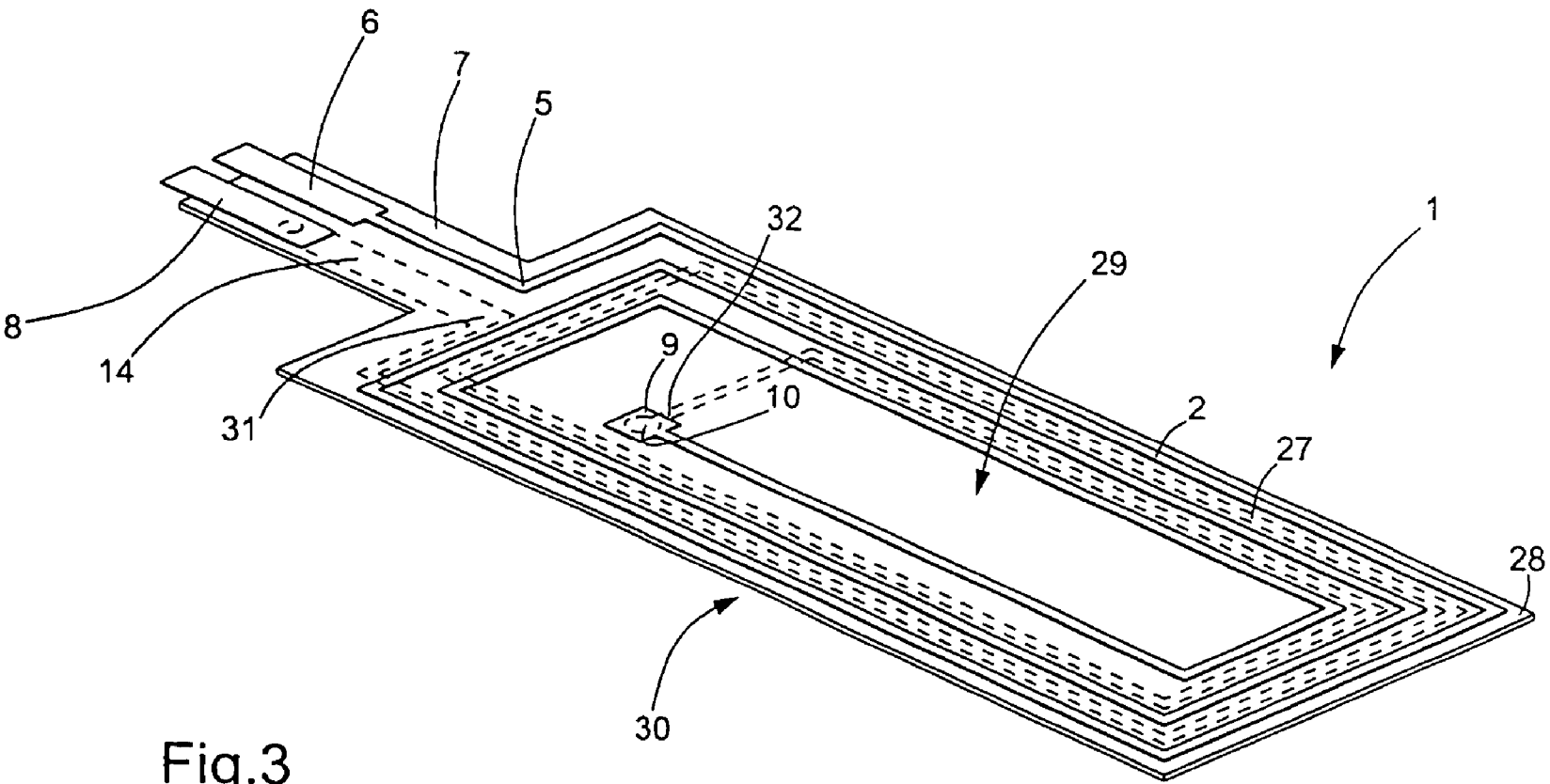
FIG. 3 is a similar top view to that of FIG. 1, for a second embodiment of the antenna according to the present invention.

FIG. 3 shows a second embodiment of antenna 1 of portable electronic device 15 according to the present invention, wherein said antenna 1 includes two coils 2, 27 printed on the same substrate 28. Substrate 28 is of the same type as the one 4 previously described with reference to FIG. 1, the only difference being that its thickness has to be substantially greater than that of said substrate 4 of FIG. 1. Indeed, since coils 2, 27 are made opposite each other on each of faces 29, 30 of substrate 28, they can consequently have a stray capacitive coupling detrimental to the reception quality of antenna 1. As was mentioned hereinbefore, the amplitude of this capacitive coupling depends on the width of the respective windings of the two oils 2, 27 and on the operating frequency. Those skilled in the art will have no particular difficulty in adjusting the thickness of substrate 28 in order to find a compromise between the space requirement of antenna 1 and the influence of the capacitive coupling on its reception sensitivity.

One can see in FIG. 3 the elements already described with reference to FIG. 1, namely coil 2 having a first end 5 outside the spiral and a second end 9 inside the spiral, rectangular connectors 6, 8 and the two apertures 10, 12 in substrate 28 allowing electric connection and metallisation path 14 to be established on back face 30 of substrate 28.

One can also see second coil 27 of generally spiral shape, printed on back face 30 of substrate 28, the first end 31 of which outside the spiral is connected to said back metallisation path 14. The second end 32 of coil 27, located inside the spiral is connected to aperture 10 connecting second end 9 of first coil 2 to the back face30 of substrate 28, such that the two coils 2 and 27 are series connected.

Furthermore, it should be noted that in order to improve the sensitivity of antenna 1 thereby obtained, the two coils 2, 27 are wound in the opposite direction to each other. Indeed, in the non limiting example shown in FIG. 3, coil 2 located on top face 29 of substrate 28 is wound in the negative trigonometric direction, when one travels along it from its first external end 5 towards its internal end 9, whereas second coil 27 located on back face 30 of substrate 28 is wound in the positive trigonometric direction, when one travels along it from its first external end 31 to its internal end 32. In this way the respective induced currents resulting from the application of a same magnetic field on the respective coils 2, 27 have the same direction of flow and are thus added before being received by integrated radiobroadcast signal processing circuit 22.

It may also be noted that with the configuration shown in FIG. 3, in which coils 2 and 27 are not superposed, the risk of capacitive coupling is reduced compared to a configuration in which the windings are superposed.

The method for manufacturing antenna 1 shown in FIG. 3 is similar to that used for manufacturing the antenna shown in FIG. 1.

Likewise, the arrangement of this antenna answers the same requirements as those previously described with reference to FIG. 2.

The preceding description corresponds to preferred embodiments of the invention and should in no way be considered as limiting, in particularly as regards the number or the relative arrangements of the coils when the antenna includes several coils. One may in fact use for example an antenna with two coils supported by two distinct substrates, said substrates being respectively housed in the two respective sides of the case of the portable electronic device according to the invention. In other words, in the case of a wristband with two strands, each of the two coils can be housed in a different strand. In such case, additional contacts must of course be provided on the printed circuit board as well as additional metallisation paths.

It is also possible to integrate a clockwork movement (designated by the reference 33 in FIG. 2) coupled to time display means in the portable electronic device according to the present invention.

The invention claimed is:

1. A portable electronic device including a wristband, a case and an electronic circuit for receiving radiobroadcast signals comprising an antenna arranged in said wristband, wherein said antenna includes at least a first flat coil and a second flat coil each being made in the form of a spiral shaped winding, said antenna being printed on a flexible substrate having two opposite faces and wherein said two coils are respectively printed on one and the other faces of the substrate.

2. The electronic device according to claim 1, wherein because of their respective spiral-shaped windings, said coils each have a first end located outside the corresponding winding and a second end located inside said winding, said second respective ends being connected via a hole made through the substrate and filled with an electrically conductive material.

3. The electronic device according to claim 2, wherein when one is situated at a fixed observation point and one considers each winding from its first end, said coils have opposite winding directions.

4. The electronic device according to claim 1, wherein said case is watertight, wherein said radiobroadcast signal receiving circuit includes an integrated circuit located in said case, said integrated circuit allowing said radiobroadcast signals to be processed, and wherein means are provided for connecting said antenna to said integrated circuit in a sealed manner.

5. The electronic device according to claim 4, wherein said connection means include metallic connectors, passing through an appropriate aperture in said case in which at least one sealing gasket is arranged.

6. The electronic device according to claim 5, wherein said metallic connectors are also printed on said substrate.

7. The electronic device according to claim 5, wherein the metallic connector or connectors connecting said first end or ends located outside said windings is or are made in a single piece with said windings.

8. The electronic device according to claim 5, wherein said metallic connectors are made of copper.

9. The electronic device according to claim 5, wherein the dimensions of the antenna are provided such that said antenna is capable of receiving radiobroadcast signals having a carrier frequency of the order of one hundred MHz.

10. The electronic device according to claim 5, wherein said case further includes a clockwork movement coupled to time display means.

11. The electronic device according to claim 10, wherein said antenna is housed in said wristband, such that the thickness of the wristband located on the side of the external surface is greater than the thickness of the wristband located on the other side.

12. The electronic device according to claim 5, wherein said antenna is housed in said wristband, such that the thickness of the wristband located on the side of the external surface is greater than the thickness of the wristband located on the other side.

13. The electronic device according to claim 4, wherein said integrated circuit is carried by a printed circuit board, means being provided to connect said metallic connectors to said printed circuit board defining contact points on said printed circuit board, the latter further including metallisation paths provided for connecting said contact points to said integrated circuit.

14. The electronic device according to claim 1, wherein said coils are made of copper.

15. The electronic device according to claim 1, wherein the dimensions of the antenna are provided such that said antenna is capable of receiving radiobroadcast signals having a carrier frequency of the order of one hundred MHz.

16. The electronic device according to claim 15, wherein said case further includes a clockwork movement coupled to time display means.

17. The electronic device according to claim 1, wherein said antenna is housed in said wristband, such that the thickness of the wristband located on the side of the external surface is greater than the thickness of the wristband located on the other side.

* * * * *